United States Patent [19]

Grossmann et al.

[11] 4,002,785

[45] Jan. 11, 1977

[54] ORGANIC COMPOUND

[75] Inventors: Marcel Grossmann, Reinach; Richard Hochreuter, Oberwil, both of Switzerland

[73] Assignee: Sandoz Ltd., Basel, Switzerland

[22] Filed: Aug. 22, 1975

[21] Appl. No.: 606,929

Related U.S. Application Data

[63] Continuation-in-part of Ser. No. 446,055, Feb. 26, 1974, abandoned.

[30] Foreign Application Priority Data

Feb. 27, 1973 Switzerland ..... 2812/73

[52] U.S. Cl. ..... 427/389; 260/29.6 E; 260/29.6 N; 260/29.7 E; 260/29.7 N; 427/390 R; 428/290; 428/287

[51] Int. Cl.[2] ..... B05D 3/02; B32B 27/06

[58] Field of Search ..... 260/29.6 E, 29.6 N, 260/29.7 E, 29.7 N; 427/389, 390, 394, 430; 428/287, 290

[56] References Cited

UNITED STATES PATENTS

| | | | |
|---|---|---|---|
| 3,297,623 | 1/1967 | Knapp et al. | 260/29.7 |
| 3,364,158 | 1/1968 | Griffith et al. | 260/29.7 N |
| 3,374,289 | 3/1968 | Oh et al. | 428/264 |
| 3,391,107 | 7/1968 | Stahly | 260/29.7 E |
| 3,420,703 | 1/1969 | Kirkschnek et al. | 260/29.6 N |
| 3,712,828 | 1/1973 | Bernard et al. | 427/322 |

*Primary Examiner*—Murray Tillman
*Assistant Examiner*—T. De Benedictis
*Attorney, Agent, or Firm*—Gerald D. Sharkin; Richard E. Vila; Thomas C. Doyle

[57] ABSTRACT

The present invention concerns a method of producing non-woven fabrics by impregnating a non-woven fibrous web with a binding agent dispersion characterized by the use of a compound of the formula:

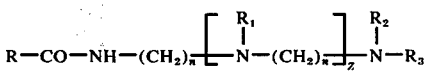

wherein

R is a substituted or unsubstituted aliphatic hydrocarbon substituent, $R_1$, $R_2$ and $R_3$ are each hydrogen, alkyl or polyalkoxy substituents

*n* is an integer and

Z is zero or an integer in free base, acid addition salt or quaternary ammonium salt form, to prevent migration of the binding agent.

16 Claims, No Drawings

ORGANIC COMPOUND

This application is a continuation-in-part of our copending application Ser. No. 446,055 filed Feb. 26, 1974, and now abandoned.

The present invention relates to non-woven fabrics produced by impregnating a non-woven fibrous web with a dispersion of a binding agent and more specifically to the inhibition of migration of the binding agent to the surface of the web on drying the impregnated web in the production of a non-woven fabric.

In the production of non-woven fabrics, during the drying step thereof, it is found that on evaporation of the aqueous dispersion medium of the binding agent, the binding agent tends to migrate to the surface of the fabric leading to an undesirably hard finish in the complete fabric. In order to avoid this undesirable migration of the binding agent, migration inhibitors comprising essentially a thickening agent have been proposed, being thermosensitive and thickening with increase in temperature. However, such agents are highly viscous even at normal temperatures so that uniform impregnation of a non-woven fibrous web with a binding agent/-thickening agent dispersion is achieved only with much difficulty.

Accordingly, the present invention provides a method of producing a non-woven fabric which comprises impregnating a non-woven fibrous web with a compound of formula I,

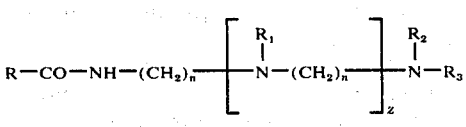

I wherein

R is alkyl ($C_5$–$C_{21}$), alkenyl ($C_5$–$C_{21}$) or alkyl ($C_5$–$C_{21}$) substituted by hydroxy or containing an oxo group, $R_1$, $R_2$ and $R_3$ are each, independently, hydrogen, alkyl ($C_1$–$C_3$) or a radical

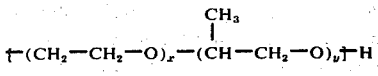

wherein each of $x$ and $y$ are independently zero or an integer 1 to 60, the sum of each of the integers $x$ and $y$ in the molecule of the compound of formula I being an integer 1 to 60, $n$ is an integer 2 or 3 and Z is zero or an integer 1 to 3, in free base, acid addition salt or quaternary ammonium salt form, and with a binding agent aqueous dispersion, and heating the impregnated web to cause coagulation of the binding agent and to effect drying.

It has been found that in the presence of a compound of formula (I), a binding agent dispersion has a controllable sensitivity and upon heating a non-woven fibrous web impregnated in accordance with the method of the invention, the binding agent breaks away from the dispersion and coagulates with the migration inhibitor of formula (I) to form a highly viscous or semi-solid immobile mass which tends not to migrate to the surface of the fibrous web during drying thereof. The coagulation occurs almost instantaneously as soon as a limiting temperature is attained, the limiting temperature being dependent on such factors as the pH of the dispersion and the concentrations of the binding agent and migration inhibitor of formula (I) and thus being variable. In general, the limiting temperature lies in the range 25° to 200° C, preferably 30° to 150° C and more preferably 40° to 100° C.

The exact mechanism by which the migration inhibitor operates is uncertain, although it is believed to operate by virtue of the combination of an electrical interaction between the migration inhibitor of formula (I) and the binding agent dispersion and the inverse solubility of the migration inhibitor which causes it to precipitate once the limiting temperature has been reached, taking with it the binding agent. Thus, it is believed that the migration inhibitor neutralizes or partially neutralizes the effect of the dispersion agent already in the binder dispersion, but prevents the binder from coagulating prematurely by virtue of its own dispersing properties which are effective as long as the temperature is maintained below the limiting temperature. Because a dispersing effect as well as an ionization effect is present, the resulting compositions have good stability and critical manipulation of all variables is not necessary.

The limiting temperature can be readily determined for any combination of binder and compound of formula (I) by the following procedure:

A quantity of binding agent dispersion is diluted with water to a suitable concentration and an equal amount of the diluted dispersion is placed in each of three beakers. An equal amount of the compound of formula (I) is added to each beaker to give a content of about 10% by weight based on the weight of binding agent solids. The pH's of the three test samples are adjusted to 4, 6 and 8 respectively. (If a more precise determination is desired, more beakers can be employed and a larger number of different pH's tested). The beakers are then heated and the temperature noted when the content of each beaker coagulates. The samples coagulating at the lowest temperature indicates the most favorable pH. Three more beakers (or more if a more precise determination is desired) are again filled with equal amounts of the diluted binding agent dispersion. To each is added a different amount of compound of formula (I) to give concentrations of, e.g. 5%, 10% and 20%. The pH of all samples are adjusted to that which was found to be most favorable and the samples are heated until coagulation occurs. The sample coagulating at the lowest or most appropriate temperature for the intended use, indicates the concentration of migration inhibitor that should be used at the pH which had already been determined.

The present invention can be employed depending on the particular binding agent dispersion, over a pH range of 1 to about 8, although for many substrates it is advisable to maintain the pH in the range 4 to 8. The preferred range is 4 to 6.

It has further been found that the compounds of formula (I) substantially reduce the migration of dyes incorporated in non-woven fibrous webs during the drying thereof, if the dye is first incorporated in the binding agent aqueous dispersion prior to the impregnation of the non-woven fibrous web with the latter and a compound of formula (I) according to the process of the invention. The use of a compound of formula (I) according to the process together with a dye thus not only substantially reduces the migration of the binding agent through the fibres in the web but also has the same effect on the incorporated dye, with the result that the non-woven fabric produced after the heating and drying stage in the process is rendered more evenly coloured through the more even dye penetration of the web. Accordingly, a further feature of the present invention is the aforedescribed process, in which the binding agent aqueous dispersion contains a dye.

Binding agent aqueous dispersions which can be modified in accordance with the present invention are, in general, polymer dispersions. However, it is also contemplated that improved coagulating properties can be imparted to dispersions of rubber, such as are used in the molding of rubber gloves, and it is to be understood that the terms "binding agent" and "binder", as used herein, include such rubber dispersions.

Examples of binding agents that may be mentioned are homo- and copolymers of butadiene, styrene, acrylonitrile, isobutylene, vinyl esters such as vinyl acetate and propionate, vinyl halides, vinylidene chloride, acrylic esters such as methyl and butyl acrylate, methacrylic esters, methylene-bis-acrylic amide, (methyl)-acrylic amide together with their emulsion polymerization catalysts or dimethylol urea, dimethylol propylene urea, dimethylol melamine, dimethylol methylcarbamate and other cross-linking agents.

The structural formulae of dispersion agents which are present in commercially available binding agent dispersions are, generally, not released by the manufacturers. Examples of binding agent dispersions which are commercially available and inevitably include a dispersing agent are the following products, identified under their trade names viz: Perbunan N Laxtex 3415 M — manufactured by and available from Bayer A. G. Leverkusen, West Germany, Primal E-32, Primal HA-16 and Primal HA-12 — all manufactured by and available from Rohm and Haas Inc., Philadelphia, USA, Acronal 30 D and Acronal 35 D — both manufactured by and available from BASF, Ludwignshafen, West Germany.

The process of the present invention, because of the cationic nature of the compounds of formula (I), is most suitable for use with binders which have been stabilized with an anionic dispersing agent. However, it has also been employed with binders which are said to be stabilized with a non-ionic dispersing agent. It is believed that in such instances the binder itself has an anionic character which is affected by the addition of the migration inhibitor.

The nature of the non-woven fibrous web material employed in the production of non-woven fabric is found to have little effect on the migration inhibiting properties of the compounds of formula I. Examples of typical non-woven natural and synthetic materials are cotton, wood fibres, jute, sisal, wool, silk, viscose, polyamide, polyacrylonitrile, polyester and polypropylene and mixtures thereof.

The production of the impregnation bath is generally effected in manner known per se, e.g. by mixing the various components. Increased solubility of the migration inhibitors of formula I in water is obtained by using the compounds in quaternary ammonium salt or acid salt form.

Impregnation of the non-woven fabrous web with the migration inhibitor of formula I and impregnation of the web with the binding agent dispersion are preferably effected simultaneously.

The present invention also provides an improved binding agent dispersion comprising a binding agent, a dispersion agent and a migration inhibitor of formula I, dispersed in aqueous medium as well as a method for preparing such improved dispersion comprising adding to a binding agent aqueous dispersion a compound of formula I.

It has also been found that if a dye, e.g. a pigmented dyestuff is included in the improved binding agent dispersion of the invention, then the tendency of the dye in a non-woven fibrous web impregnated with the improved binding agent dispersion containing the dye, to migrate on drying is substantially reduced whereas satisfactory dye penetration in the web is permitted.

Accordingly, the invention further provides an improved binding agent and dye dispersion comprising a binding agent, a migration inhibitor of formula I and a dye, dispersed in aqueous medium.

The ratio of the weight of the migration inhibitor of formula I: binding agent solid in the dispersion to be employed in the method or improved dispersion of the invention is preferably from 1 to 50 : 100, more preferably from 5 to 25 : 100, e.g. from 10 to 15 : 100, respectively.

Preferably, the radical R—CO— of the compound of formula I is derived from a natural fatty acid i.e. of formula R—CO—OH.

As examples of saturated fatty acids may be mentioned capronic acid ($C_6$), caprylic acid ($C_8$), capric acid ($C_{10}$), lauric acid ($C_{12}$), myristic acid ($C_{14}$), palmitic acid ($C_{16}$), stearic acid ($C_{18}$), arachic acid ($C_{20}$) and behenic acid ($C_{22}$).

As examples of natural, mono unsaturated fatty acids may be mentioned: caproleic acid ($C_{10}$), lauroleic acid ($C_{12}$), myristoleic acid ($C_{14}$), palmitoleic acid ($C_{16}$), ricinoleic acid and oleic acid ($C_{18}$).

As examples of di-unsaturated fatty acids there may be mentioned linolic acid ($C_{18}$) and of triple unsaturated fatty acids there may be mentioned linolenic acid and licanic acid ($C_{18}$).

Furthermore, the radical R—CO— of the compound of formula I may be derived from a mixture of fatty acids, e.g. tallow fatty acids consisting essentially of lauric acid, myristic acid, palmitic acid, stearic acid, oleic acid, linolic acid and arachic acid, or coconut oil acid consisting essentially of capric acid, lauric acid, myristic acid, palmitic acid, stearic acid, oleic acid and linolic acid.

Preferably R of formula I is alkyl ($C_5$–$C_{21}$) or alkenyl ($C_5$–$C_{21}$).

A preferred group of compounds of formula I are the compounds of formula Ia,

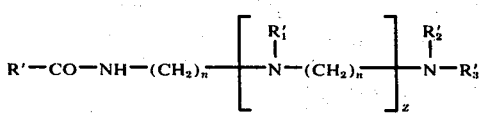

Ia wherein

R′ is alkyl ($C_5$–$C_{21}$) or alkenyl ($C_5$–$C_{21}$), $R_1'$, $R_2'$ and $R_3'$ are each, independently a radical

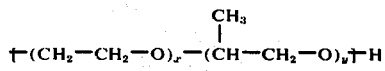

wherein $x$ and $y$ are as defined above and $n$ and Z are as defined above, in free base, acid addition salt or quatenary ammonium salt form thereof.

Examples of compounds of formula I that may be mentioned are the compound of formulae:

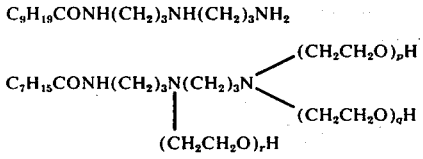

wherein each of $p$, $q$and $r$ is an integer, the sum of $p$, $q$ and $r$ being 4,

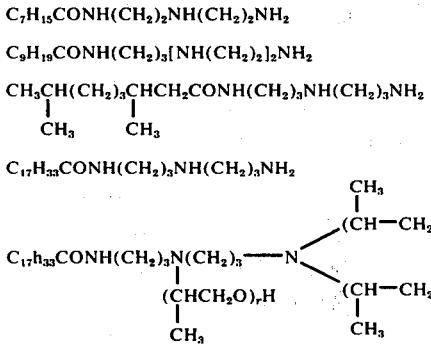

wherein each of $p$, $q$, and $r$ is an integer, the sum of $p$, $q$ and $r$ being 52,
and

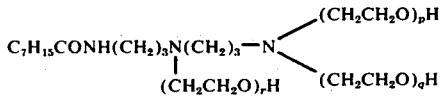

wherein each of $p$, $q$ and $r$ are integers, the sum of $p$, $q$ and $r$ being 42.

Some of the compounds of formula Ib,

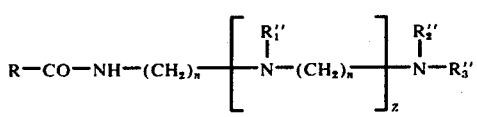

IB wherein R, $n$ and Z are as defined above and $R_1''$, $R_2''$ and $R_3''$ are each, independently, hydrogen, alkyl ($C_1$–$C_3$), or a radical

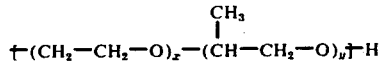

wherein $x$ and $y$ are as defined above, at least one of $R_1''$, $R_2''$ and $R_3''$ being hydrogen or alkyl ($C_1$—$C_3$), are known. They may, for example, be generally produced by thermally condensing a fatty acid as such, or a functional derivative thereof, e.g. the ester, acid anhydride, mixed anhydride or acid chloride with a polyalkylene polyamine which does not contain a polyethylene and/or polypropylene glycol radical at a temperature of between 100° to 200° C. A carrier such as xylene which forms an azeotropic mixture with water may also be used. The two components are, for example, melted together and the released water is distilled off. The mixture is preferably heated in an inert gas atmosphere until the reaction mixture has reached an acid number under 10, preferably under 5. The control may be made by titration. A process for the acylation of polyalkylene polyamines is described in British Patent No. 657.419. The resulting condensation products may be used directly or be converted into their glycol derivatives by the addition of ethylene or propylene oxide. A process for the addition of alkylene oxide is described in U.S. Pat. No. 2,790,003.

As examples of amines which may be used for the condensation may be mentioned: ethylene diamine, propylene diamine, diethylene triamine, dipropylene triamine, triethylene tetramine, tripropylene tetramine, tetraethylene pentaamine, tetrapropylene pentaamine, N-methyl-amino-bis-propylene, N-(2-hydroxyethyl)-ethylene diamine. For the oxalkylation ethylene and propylene oxide are used.

Examples of fatty acids are listed above.

Acid addition salt and quaternary ammonium salt forms of the compounds of formula I may be produced from free base forms in manner known per se and vice versa.

Thus quaternary ammonium salt forms may be prepared from free base forms by reaction with alkylating ($C_1$–$C_4$) or benzylating agents, e.g. dimethyl chloroacetamide or benzyl chloride.

Acid addition salt forms may be produced from free base forms by reaction with low molecular weight (e.g. ($C_1$–$C_4$) carboxylic acids e.g. formic acid, acetic acid, propionic acid, lactic acid or oxalic acid, or with inorganic acids such as phosphoric acid, hydrochloric acid or sulphamic acid.

The preferred compounds of formula Ia are new. They may be produced by condensing a polyalkylene polyamine of formula X,

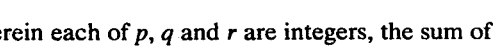

X wherein $n$, and Z are as defined above, with an acid of formula XI,

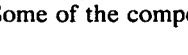

XI wherein R′ is as defined above, or a functional derivative thereof, e.g. an ester or acid halide thereof, preferably in a molar ratio of 1 : 1 respectively, and reacting the resulting product of formula Id,

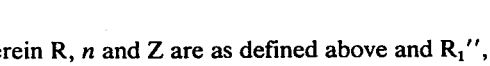

Id wherein R′, $n$ and Z are as defined above, with ethylene and/or propylene oxide, preferably in a molar ratio of 1 : 1 to 60 respectively.

The amidation and alkoxylation steps described above for the production of compounds of formula Ia may be effected in manner known per se.

In the following examples, parts and percentages are by weight and the temperature is in ° C.

EXAMPLE 1

A mechanically pre-solidified fibre sheet consisting a rayon staple fibre and polyester shrinking fibres, is treated with an impregnation bath which has the following constituents:

| | | |
|---|---|---|
| | 142 | parts of an aqueous dispersion which contains 47.5 % butadiene-acrylonitrile binder, commercially available under the trade name Perbunan N Latex 3415 M - manufactured by and available from Bayer A.G. Leverkusen, West Germany. |
| | 848 | parts of water, |
| and | 10 | parts of a compound of formula: $C_9H_{19}CONH(CH_2)_3NH(CH_2)_3NH_2$ |
| | 1000 | parts |

The pH of the impregnation bath is 4.3 and the pick up is 200% based on the dry weight of the sheet.

For the drying of the impregnated non-woven fabric a combination, consisting of infra-red and convection dryers, is used. The thin steam phase produced on both surfaces of the non-woven fabric by the infra red dryer causes a shock-like coagulation of the binding agent on the fibre and thus thermomigration of the binding agent is prevented. Drying is completed at 150° in a convection dryer.

Compared with a product treated in the absence of a compound of formula I, this non-woven fabric has the advantages that the distribution of the binder is homogeneous, no delamination takes place and no hardening of the handle results. Similar results are obtained by using a polyacrylate instead of a butadiene-acrylonitrile binder dispersion. The exact composition of the commercial product employed is not released by the manufacturer and cannot be determined.

EXAMPLE 2

A hydrodynamically formed viscose fibre sheet is treated in accordance with Example 1 with an impregnation bath of the following constituents:

| | | |
|---|---|---|
| | 138 | parts of an aqueous dispersion which contains 46 % of polyacrylate binder, commercially available under the trade name Primal E-32 - manufactured by and available from Rohm and Haas Inc., Philadelphia, USA |
| | 848.7 | parts of water, |
| | 3.3 | parts of C.I. pigment Red 5, Colour Index No. 12490 |
| and | 10 | parts of a compound of formula: |
| | 1000 | parts |

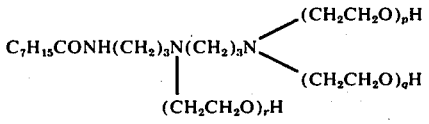

wherein $p$, $q$ and $r$ are integers, the sum thereof being 4.

The pH of the impregnation bath is 4.5 and the pick up is 100% based on the dry weight of the sheet.

After the impregnation the non-woven fabric is dried on one side in an infra-red-field. Without the addition of the compound of formula I the binding agents and dyestuffs migrate to the surface presented to the infra-red radiators. This migration is prevented by using the above described impregnation bath.

After processing in accordance with Example 2 the sheet shows further advantages:

no colour two-sidedness, i.e. homogeneous distribution of the dyestuff through the fabric,
no undesirable changes in handle,
no pilling formation.

By repeating the procedure of Example 1, but replacing the compound of formula I employed by 10 parts of an agent of formula:

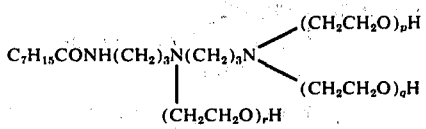

wherein $p$, $q$ and $r$ are integers, the sum of $p$, $q$ and $r$ being 42, similarly good results are obtained.

EXAMPLE 3

A spinning web consisting of polyester fibre is padded in accordance with Example 1 with a padding bath of the following composition:

| | | |
|---|---|---|
| | 138 | parts of an aqueous dispersion which contains 46 % of polyacrylate binder, commercially available under the trade name Primal HA-16 - manufactured by and available from Rohm and Hass Inc., Philadelphia, USA. |
| | 848.3 | parts of water, |
| | 3.7 | parts of C.I. pigment Green 7, Colour Index No. 74260, |
| and | 10 | parts of a compound of formula: $C_7H_{15}CONH(CH_2)_2NH(CH_2)_2NH_2$ |
| | 1000 | parts |

The pH of the padding liquor is 5.1 and the pick up is 100% based on the dry weight of the web. The padded non-woven fabric is dried at 150° in a circulating air dryer.

Compared with a product treated in the absence of the compound of formula I, this fabric has the same advantages as indicated in Example 1.

EXAMPLE 4

A bulky polyamide card web is treated in accordance with Example 1 with an impregnation bath of the following composition:

| | | |
|---|---|---|
| | 135 | parts of an aqueous dispersion which contains 45 % of polyacrylate binder, commercially available under the trade name Primal HA-12 - manufactured by and available from Rohm and Hass Inc., Philadelphia, USA. |
| | 851.2 | parts of water, |
| | 3.8 | parts of C.I. pigment Yellow 1, Colour Index No. 11680 |
| and | 10 | parts of a compound of formula: $C_9H_{19}CONH(CH_2)_3[NH(CH_2)_3]_2NH_2$ |
| | 1000 | parts |

The pH of the impregnation bath is 4.6 and the pick up is 150%, based on the dry weight of the web. The non-woven fabric is dried at a circulating air temperature of 140% in a convection dryer.

Compared with a product treated in the absence of a compound of formula I, this fabric has the same advantages as indicated in Example 1.

EXAMPLE 5:

A viscose/cellulose web produced in accordance with the wet process is padded according to Example 1 with a bath of the following composition:

| | |
|---|---|
| 120 | parts of an aqueous dispersion which contains 40 % of polyacrylate binder, commercially available under the trade name Acronal 30 D - manufactured by and available from BASF, Ludwigshafen, West Germany. |
| 867.2 | parts of water, |
| 2.8 | parts of C.I. pigment Black 7, Colour Index No. 77266, |
| and 10 | parts of a compound of formula: |

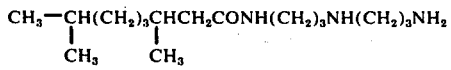

| | |
|---|---|
| 1000 | parts |

The pH of the bath is 4.4 and the pick up is 100% based on the dry weight of the web. The non-woven fabric is dried at 160° in a convection dryer. The advantages indicated in Example 1 are obtained.

EXAMPLE 6

A viscose/cellulose web is padded in accordance with Example 1 with an impregnation bath of the following composition:

| | |
|---|---|
| 150 | parts of an aqueous dispersion which contains 50 % of a thermally cross-linkable copolymer based on acrylic ester, commercially available under the trade name Acronal 35 D - manufactured by and available from BASF, Ludwigshafen, West Germany. |
| 837.2 | parts of water, |
| 2.8 | parts of C.I. pigment Yellow 1, Colour Index No. 11680 |
| and 10 | parts of a compound of formula: $C_{17}H_{33}CONH(CH_2)_3NH(CH_2)_3NH_2$ |

The pH of the impregnation bath is 4.1 and the pick up is 150%, based on the dry weight of the web. The impregnated non-woven fabric is dried on one side in an infra-red dryer. The same advantages as indicated in Example 1 are obtained.

Replacing the above described migration inhibitor by an agent of formula:

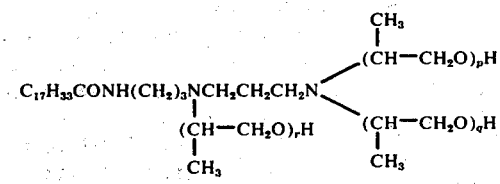

wherein $p$. $q$ and $r$ are integers, the sum of $p$, $q$ and $r$ being 52, the results as described in Examples 1 and 2 are obtained.

EXAMPLE 7

The compound of the formula:

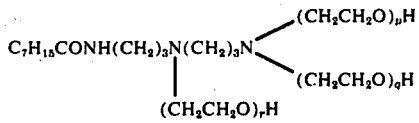

wherein $p$, $q$ and $r$ are integers, the sum thereof being 42, employed in Example 2 is produced as follows: 141 Parts (1 mol) of caprylic acid are melted in a flask and 197 parts (0.9 mol) of dipropylene triamine are allowed to flow into the melt at 100°. The reaction mixture is then heated to 170° over the course of approximately 6 hours by passing nitrogen through it. The reaction water is distilled off and collected in a water separator. When a total of 18 parts of water is distilled off and the acid number of the product is lowered to 1.8, the mixture is allowed to cool to 100°. A total of 1848 parts (42 mols) of ethylene oxide is added at this temperature. The resulting product is appropriate for the inhibition of migration of the binding agent in the production of a non-woven fabric.

EXAMPLE 8

The compound of the formula:

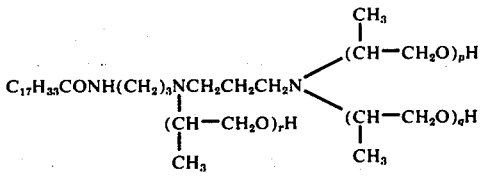

wherein $p$, $q$ and $r$ are integers, the sum of $p$, $q$ and $r$ being 52, employed in Example 6 is produced as follows: 272 Parts (1 mol) of oleic acid and 131 parts (1 mol) of dipropylene triamine are thermally condensed with the cleavage of water at a temperature of from 150°–190° in a reaction flask in a manner similar to that described in Example 7. The condensation is continued under vacuum until 18 parts of water are distilled off and the acid number of the product is 0.

The mixture is then allowed to cool to approximately 110° and the product is further reacted by the slow dropwise addition of 3016 parts (52 mols) of propylene oxide. The resulting propylene oxide adduct is appropriate for the inhibition of migration of the binding agent and the dyestuff in the production of a non-woven fabric. A product with similar properties is obtained by reacting a condensation product consisting of 270 parts (1 mol) of technical stearic acid and 103 parts (1 mol) of diethylene triamine first at 140° with 880 parts (20 mols) of ethylene oxide and then at 100° with 1044 parts (18 mols) of propylene oxide.

What is claimed is:

1. A method of producing a non-woven fabric which comprises impregnating a non-woven fibrous web with a migration inhibitor of the formula:

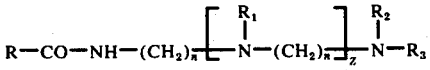

wherein

R is alkyl ($C_5$–$C_{21}$), alkenyl ($C_5$–$C_{21}$) or alkyl ($C_5$–$C_{21}$) or alkenyl ($C_9$–$C_{21}$) substituted by hydroxy or containing an oxo group, $R_1$, $R_2$ and $R_3$ are each, independently, hydrogen, alkyl ($C_1$–$C_3$) or a radical

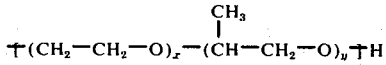

wherein each of $x$ and $y$ are independently zero or an integer 1 to 60, the sum of each of the integers $x$ and $y$ in the molecular of the compound of formula I being an integer 1 to 60, $n$ is an integer 2 or 3 and Z is zero or an integer 1 to 3, in free base, acid addition salt or quaternary ammonium salt form, and with an aqueous dispersion of a synthetic resin binder, and heating the impregnated web to cause coagulation of the binding agent and to effect drying.

2. A method according to claim 1, wherein R is alkyl ($C_5$–$C_{21}$) or alkenyl ($C_5$–$C_{21}$).

3. A method according to claim 1, wherein the non-woven fabric web is impregnated with a migration inhibitor of the formula:

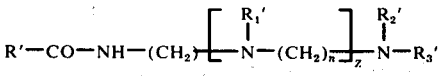

wherein

R′ is alkyl ($C_5$–$C_{21}$) or alkenyl ($C_5$–$C_{21}$), $R_1$′, $R_2$′ and $R_3$′ are each, independently a radical

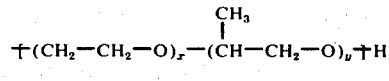

wherein $x$ and $y$ are as defined in claim 1, and $n$ and Z are as defined in claim 1, in free base, acid addition salt or quatenary ammonium salt form thereof.

4. A method according to claim 3, wherein the non-woven fabric is impregnated with a compound of the formula:

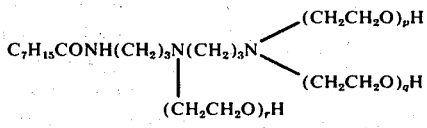

wherein $p$, $q$ and $r$ are integers, the sum thereof being 4.

5. A method according to claim 1, wherein the non-woven fabric is impregnated with a compound of the formula:

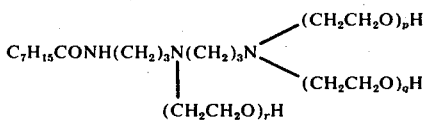

wherein $p$, $q$ and $r$ are integers, the sum of $p$, $q$ and $r$ being 42.

6. A method according to claim 1, wherein the non-woven fabric is impregnated with a compound of the formula:

$$C_7H_{15}CONH(CH_2)_2NH(CH_2)_2NH_2$$

7. A method according to claim 1, wherein the non-woven fabric is impregnated with a compound of the formula:

$$C_9H_{19}CONH(CH_2)_3[NH(CH_2)_3]_2NH_2$$

8. A method according to claim 1, wherein the non-woven fabric is impregnated with a compound of the formula:

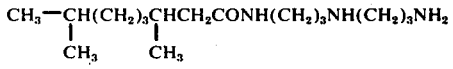

9. A method according to claim 1, wherein the non-woven fabric is impregnated with a compound of the formula:

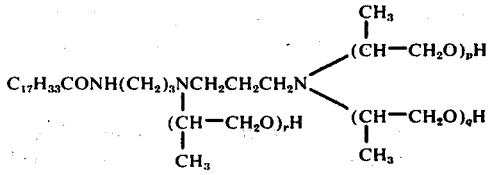

wherein $p$, $q$ and $r$ are integers, the sum of $p$, $q$ and $r$ being 52.

10. A method according to claim 1, wherein the non-woven fabric is impregnated with a compound of the formula:

$$C_9H_{19}CONH(CH_2)_3NH(CH_2)_3NH_2$$

11. A method according to claim 3, wherein the impregnated web is heated to a temperature between 30° and 200° C.

12. A method according to claim 3, wherein the ratio of the weight of the migration inhibitor: binding agent solid in the dispersion is from 10 to 50 : 100, respectively.

13. A method according to claim 3, wherein the binding agent of the binding agent aqueous dispersion is selected from homo- and copolymers of butadiene, styrene, acrylonitrile, isobutylene, vinyl halides, vinylidene chloride, acrylic esters, methacrylic esters, methylene-bis-acrylic amide, (methyl)-acrylic amide, dimethylol urea, dimethylol propylene urea, dimethylol melamine and dimethylol methyl-carbamate.

14. A method according to claim 3, wherein the non-woven fibrous web is selected from cotton, wood fibres, jute, sisal, wool, silk, viscose, polyamide, polyacrylonitrile, polyester and polypropylene and mixture thereof.

15. A method according to claim 1, wherein the synthetic resin binder dispersion contains an anionic or non-ionic dispersing agent.

16. A method according to claim 15 wherein the synthetic resin binder dispersion contains an anionic dispersing agent.

* * * * *